United States Patent [19]

Geiger et al.

[11] 3,976,405

[45] Aug. 24, 1976

[54] PUMP

[75] Inventors: Kenneth Daniel Geiger, Port Credit; Steven Joseph Horvath, Mississauga; Paul Niessen, Waterloo; Theodore Joseph Seymour, Oakville, all of Canada

[73] Assignee: Cominco Ltd., Trail, Canada

[22] Filed: Oct. 29, 1974

[21] Appl. No.: 518,850

[52] U.S. Cl. ..... 418/102; 277/22; 418/206

[51] Int. Cl.[2] ..... F01C 19/00; F04C 27/00

[58] Field of Search ..... 92/86, 144; 415/112; 418/102, 206; 277/22

[56] References Cited

UNITED STATES PATENTS

| | | | |
|---|---|---|---|
| 2,479,077 | 8/1949 | McAlvay | 418/102 X |
| 2,799,522 | 7/1957 | King et al. | 277/22 X |
| 2,990,783 | 7/1961 | Oliver | 418/102 |
| 3,129,947 | 4/1964 | Streck | 277/22 |
| 3,331,608 | 7/1967 | Charrault et al. | 277/22 X |
| 3,554,558 | 1/1971 | Rajakovics | 277/22 X |
| 3,823,949 | 7/1974 | Derks et al. | 277/22 |

FOREIGN PATENTS OR APPLICATIONS

| | | | |
|---|---|---|---|
| 1,039,562 | 8/1966 | United Kingdom | 277/22 |

*Primary Examiner*—Irwin C. Cohen
*Attorney, Agent, or Firm*—Arne I. Fors

[57] ABSTRACT

An improved gear pump for pumping molten metals, such as molten lead or lead alloy, in which sealing means are provided to prevent loss of metal flowing axially along the pump drive shaft. A cooled annulus is provided about the pump drive shaft for solidifying molten metal therein which forms an effective seal and bearing.

3 Claims, 3 Drawing Figures

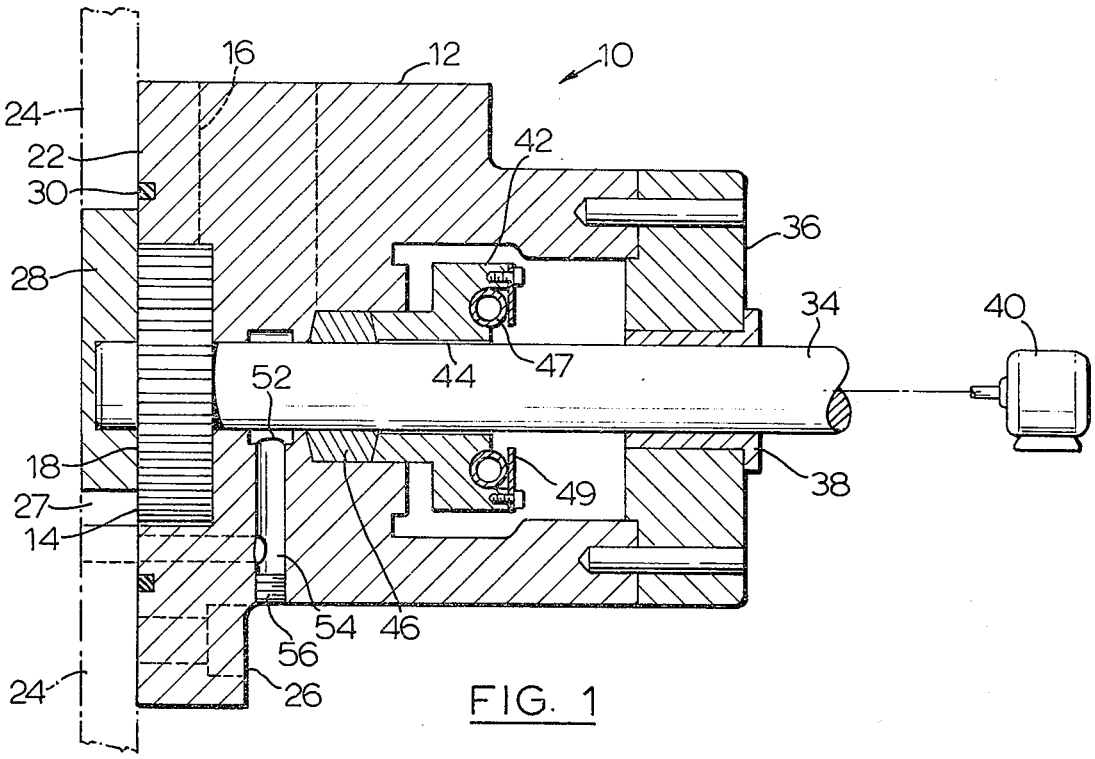
FIG. 1
FIG. 2
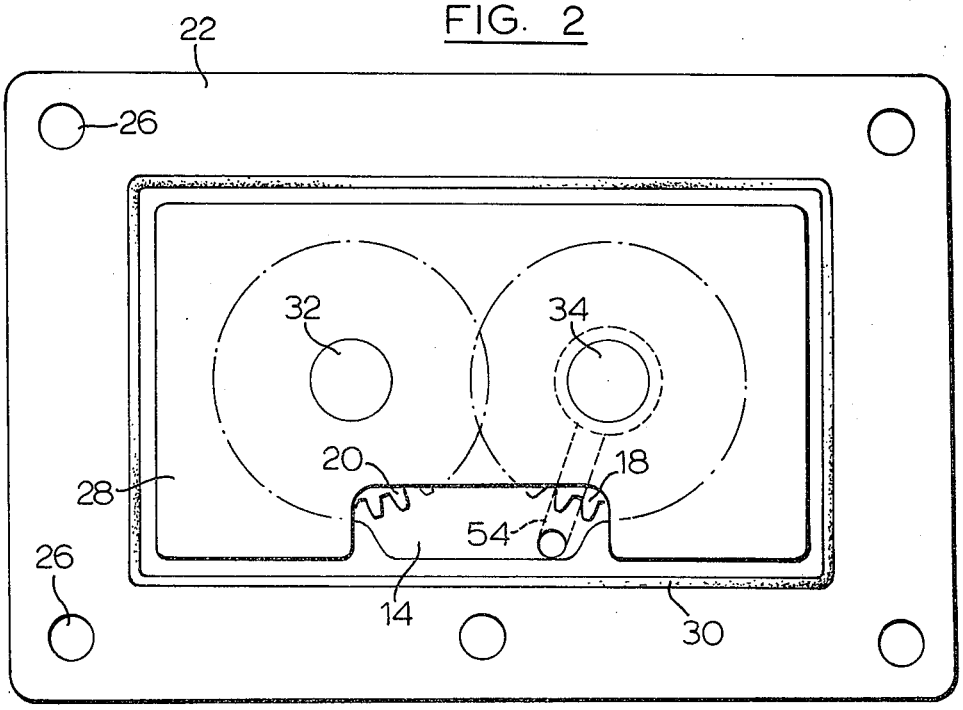

PUMP

BACKGROUND OF THE INVENTION

The present invention relates to an improved pump for pumping molten metals and is directed to means for controlling leakage about the drive shaft of the pump by causing metal flowing axially along the said shaft to solidify in a cooled annulus formed about the shaft to provide an effective seal. More particularly, this invention relates to an improved pump having means for sealing about the drive shaft of a gear pump used to lift molten lead or lead alloy from a melting furnace to a casting trough from which a rotating cooled drum removes sheet metal.

U.S. Pat. No. 2,864,314 provides a face-type shaft sealing assembly for a pump which handles hot fluids. One shaft-mounted face-seal member is urged by spring means against a second, housing-mounted, face-seal member. They coact to divide the interior of the pump housing into a pumping zone and a sealed chamber. A small fraction of the fluid being pumped passes through the sealing means, which is cooled, to lubricate the faces of the assembly.

Canadian Pat. No. 896,312 provides for the forming of an ice seal between the rotating shroud and the stationary housing of a turbine. The ice is initially formed when the turbine is not operating or chips of ice or other low-friction material are introduced into the sealing space during operation.

In both the foregoing patents, the fluid being pumped is used to provide sealing means. However, molten lead solidifies on cooling and its passage between relatively rotating face-sealing members would be impractical. In addition, solidification of lead on a stationary shaft would prevent start-up of the pump.

In the casting of lead alloy sheet as described in copending U.S. Pat. application No. 367,143, a smooth and steady flow of molten metal through a trough in which the periphery of a casting drum moves is essential to produce uniform cast sheet metal. Pulsating action, such as from a centrifugal pump, tends to aerate the molten metal and to promote undesirable drossing of active metal alloying additives such as calcium. The positive displacement action of a gear pump provides such desired smooth flow of molten metal from a melting furnace to the casting trough and, for easy access to the pump for maintenance, the pump preferably is mounted externally on the furnace wall. The pump is reversible, permitting immediate removal of molten metal from the casting trough and from piping in communication therewith at the end of a casting operation.

SUMMARY OF THE INVENTION

The foregoing external gear pump arrangement requires sealing means to prevent loss of molten metal due to axial flow along the outwardly extending drive shaft. Shaft sealing and lubricating means which may introduce foreign substances into the stream of molten lead alloy are to be avoided. The present invention provides an effective seal about the pump drive shaft by the provision of a cooled annulus about the shaft which causes metal flowing axially along the shaft at the start of and during operation to solidify and form an effective seal about the shaft, and to also act as a bearing. More particularly, the pump of the present invention comprises a casing defining a chamber having an inlet and an outlet, coacting gears with shafts journalled for rotation within said casing to move molten metal from said inlet through the chamber to said outlet, one of said shafts extending through said casing for connection to means for driving said shaft and the gear mounted thereon, means encircling a portion of said shaft extending through the casing defining an annulus about the shaft spaced from the gear mounted thereon whereby any molten metal leaking from the chamber along the shaft flows into the said annulus, and cooling means in proximity to the annulus for cooling and solidifying said molten metal within the annulus about the shaft whereby said solidified metal provides an effective seal and shaft bearing.

It is a principal object of the present invention to provide a seal between the shaft and the casing of a pump used for moving molten metal such as lead and is alloys by solidifying leaking molten metal to form a bearing about the shaft.

BRIEF DESCRIPTION OF THE DRAWINGS

The prevention of leakage of molten metal around the drive shaft of a gear pump will now be described in detail, reference being made to the following drawings, in which:

FIG. 1 is a vertical longitudinal section, partly in elevation, of the pump of the present invention through the centre line of the pump drive shaft on which the sealing means is used;

FIG. 2 is a transverse vertical elevation showing the inlet end of the gear pump illustrated in FIG. 1.

Like reference numerals refer to like parts throughout the description of the drawings.

DESCRIPTION OF PREFERRED EMBODIMENTS

Figure 3:
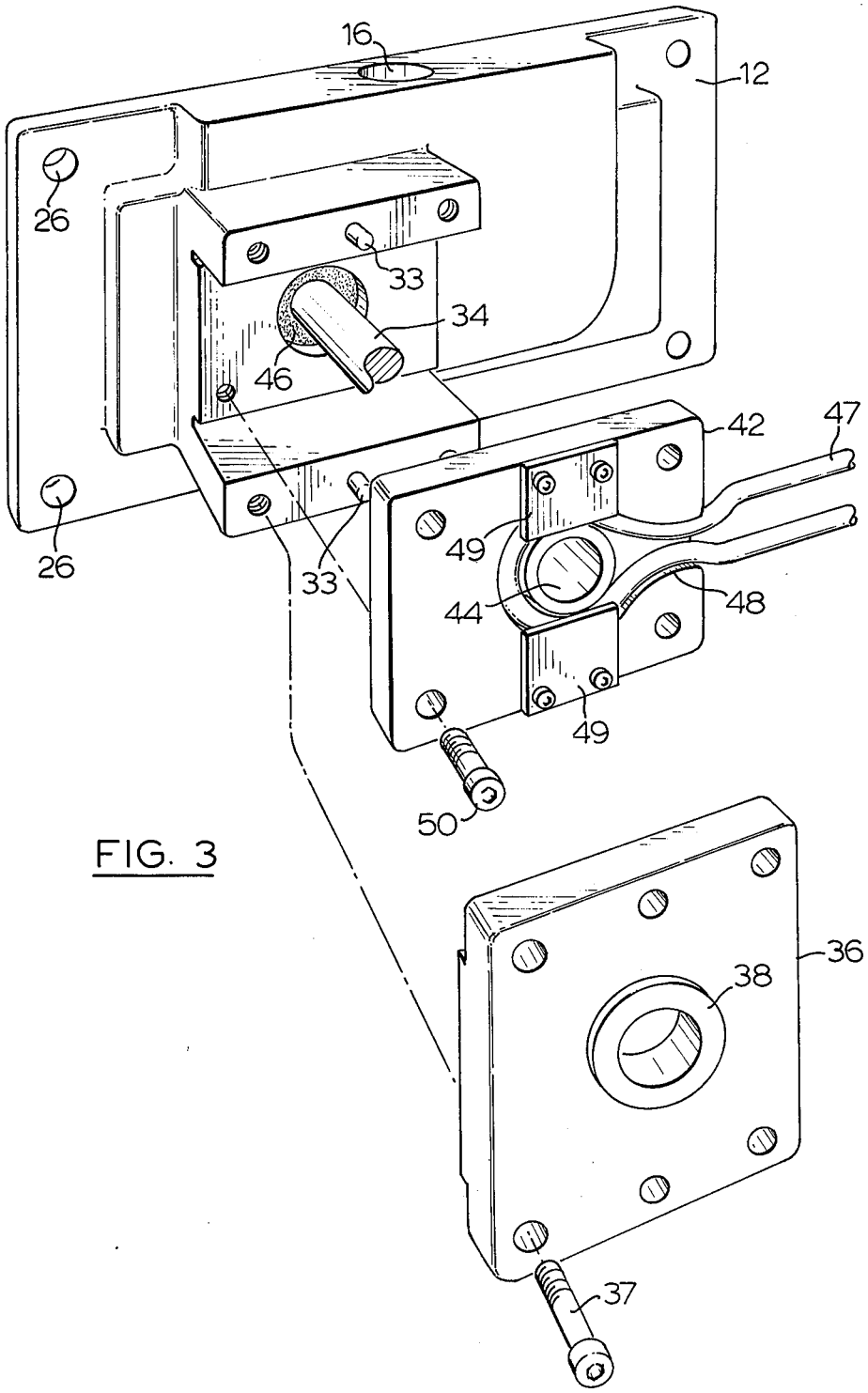
FIG. 3 is an exploded perspective view of the said pump.

Gear pump 10 comprises a casing 12 defining a chamber having an inlet 14 and an outlet 16 and coacting gears 18 and 20 journalled for rotation within the casing to move molten metal through the said chamber. Planar end face 22 at one end of gear pump 10 is adapted for mounting on a planar wall 24 of a melting furnace, a portion of which is shown, by mounting bolts through holes 26, so that a hole near the bottom of the furnace wall 24 is aligned with molten metal inlet 14 formed in pump cover plate 28. Gasket 30 seated in a continuous recess formed in end face 22 and surrounding cover plate 28 bolted to casing 12 provides a seal between end face 22 and the melting furnace wall 24. Molten metal is dicharged upwardly through outlet 16 above gears 18 and 20. Gear 20 and its shaft 32 are journalled for rotation entirely within casing 12 and cover plate 28. One end of shaft 34 with gear 18 mounted thereon is journalled for rotation within a recess in cover plate 28 while the other end extends through the casing rear wall plate 36 to be supported by a conventionally lubricated bearing 38 seated therein. Rear wall plate 36, which is aligned with casing 12 by locating pins 33, is secured to casing 12 by bolts 37, one of which is shown. Bearing 38 is mounted in wall plate 36 spaced away from the part of the casing which is in contact with molten metal, thereby avoiding overheating of the bearing lubricant. Beyond bearing 38, shaft 34 is connected to variable speed drive means represented by motor 40 for driving the shaft and the gear mounted thereon.

Leakage of molten metal between casing 12 and shaft 34 is prevented by sealing means designated by numeral 42 encircling a portion of the shaft extending within the casing and defining an annulus 44 about 0.03 inch wide about the shaft. Sealing means 42 is cooled in proximity to the annulus to solidify molten metal which enters within the annulus. Sealing means 42 may be a water cooled packing gland, as shown, which encircles shaft 34 in a zone between gear 18 and bearing 38 and which is used to retain inert heat resistant porous packing 46, e.g. asbestos, interposed between gear 18 and annulus 44. Conduit such as copper tubing 47, a portion of which is seated in recess 48 in packing gland 42 and secured thereto by plates 49 screwed to the packing gland, substantially encircles annulus 44. Tubing 47 extends laterally beyond the pump to receive and to discharge water coolant. When bolted to casing 12 by tension bolts 50, one of which is shown, gland 42 compresses packing 46 without itself touching shaft 34.

During operation of the pump, molten metal flows between shaft 34 and casing 12 to penetrate porous packing 46. Since the packing is not cooled, some molten metal may pass into annulus 44 where it is directly cooled by packing gland 42. The metal is distributed, while cooling and solidifying, about the periphery of the shaft, by rotation of the shaft. The soft solidified metal fills the gap defined by the annulus to provide a seal against further axial metal flow. Any break that may occur in this seal during pump operation is immediately repaired by the freezing within annulus 44 of any molten metal that the break may allow to advance. Because of the antifriction properties of lead, this seal also operates effectively as an inner bearing which does not require additional lubricant.

When delivery of molten metal through pump outlet 16 is discontinued, rotation of pump 10 is reversed to return molten metal to the furnace.

In a preferred modification of the invention, casing 12 is provided with an annular groove 52 which encircles shaft 34 between gear 18 and packing 46. Descending channel 54 connects groove 52 to the pump cover plate inlet 27, thereby providing for the return to the chamber inlet 14 of excess metal which might otherwise exert greater than normal operating pressure on the shaft seal. Access to this channel through the bottom of the pump casing is normally closed by plug 56.

What is claimed as new and desire to protect by Letters Patent of the United States is:

1. An improved pump for molten lead or lead alloy metal comprising, in combination, a casing defining a chamber having an inlet and an outlet, coacting gears with shafts journaled for rotation within said casing to move molten metal from said inlet through the chamber to said outlet, one of said shafts extending through said casing for clearance to means for driving said shaft and the gear mounted thereon, a packing gland encircling a portion of said shaft extending through the casing and defining a uniform open clerance annulus about the shaft spaced from the gear mounted thereon whereby said molten metal leaking from the chamber along the shaft flows into the said annulus, a heat resistant porous packing encircling and engaging the shaft and interposed axially between the casing and the packing gland, means connecting said packing gland to said casing whereby the packing gland compresses the said packing against the shaft, and cooling means formed in said packing gland in proximity to the annulus for cooling said annulus directly thereby solidifying within said annulus molten metal leaking past said packing, whereby said solidified metal provides an effective seal and shaft bearing, said cooling means comprising a recess formed in said packing gland, conduit tubing mounted in said recess for conducting a coolant therethrough to cool the packing gland, and plate securement means mounting said tubing within said recess.

2. An improved pump as claimed in claim 1 in which said annulus is about 0.03 inch wide.

3. An improved pump as claimed in claim 1 in which the casing has an annular groove formed about the shaft between the gear mounted thereon and the packing and a channel communicating the groove with the pump chamber inlet whereby molten metal leaking from the chamber along the shaft can return to the pump inlet.

* * * * *

UNITED STATES PATENT OFFICE

CERTIFICATE OF CORRECTION

Patent No. 3,976,405 Dated August 24, 1976

Inventor(s) Kenneth Daniel Geiger et al.

It is certified that error appears in the above-identified patent and that said Letters Patent are hereby corrected as shown below:

Column 2, line 16, "is" should read ---its---.

Column 4, line 11, "clearance" should read ---connection---.

Column 4, line 14, "clerance" should read ---clearance---.

Signed and Sealed this

Seventh Day of December 1976

[SEAL]

*Attest:*

RUTH C. MASON
*Attesting Officer*

C. MARSHALL DANN
*Commissioner of Patents and Trademarks*